United States Patent [19]

Suzuki

[11] 4,360,395

[45] Nov. 23, 1982

[54] METHOD FOR PRODUCING A LAMINATED SHEATH

[75] Inventor: Fumio Suzuki, Yokohama, Japan

[73] Assignee: Sumitomo Electric Industries, Ltd., Osaka, Japan

[21] Appl. No.: 250,376

[22] Filed: Apr. 2, 1981

[30] Foreign Application Priority Data

Apr. 10, 1980 [JP] Japan ..... 55/47707

[51] Int. Cl.[3] ..... H01B 13/06

[52] U.S. Cl. ..... 156/54; 156/56; 156/201; 156/461; 156/463; 174/102 R; 174/102 D; 174/107

[58] Field of Search ..... 156/54, 56, 48, 200–203, 156/215, 218, 461, 466; 174/102 D, 102 R, 107

[56] References Cited

U.S. PATENT DOCUMENTS 3,066,063 11/1962 Ecklund et al. ..... 156/203
3,766,645 10/1973 Ziemek ..... 174/107 X
3,816,643 6/1974 Dechhold ..... 156/54 X
3,944,459 3/1976 Skobel ..... 156/461
4,130,450 12/1978 Bahder et al. ..... 427/118 X
4,151,365 4/1979 Hacker ..... 156/54 X

FOREIGN PATENT DOCUMENTS 46-10342 2/1971 Japan ..... 156/54

*Primary Examiner*—David A. Simmons
*Attorney, Agent, or Firm*—Sughrue, Mion, Zinn, Macpeak & Seas

[57] ABSTRACT

A method for producing a laminated sheath product utilizing a single layer tape and providing good waterproof characteristics. A tape is longitudinally supplied, if desired, with a core, into a first die which preliminarily shapes the tape to a partial tubular form. The tape is then passed through a second die which completes the tubular formation of the tape while applying an adhesive thereto. The adhesive at the second die completely fills the area around the overlapping edges of the tape to provide a tight waterproof seal.

34 Claims, 7 Drawing Figures

METHOD FOR PRODUCING A LAMINATED SHEATH

BACKGROUND OF THE INVENTION

The present invention relates to a method for producing a laminated sheath which is used, for example, in producing a laminated sheath cable composed of a laminated tape made of metal or the like using adhesives and a sheath which is made of plastics or the like which covers the tape in such a way as to form a lamination thereon.

In general, a laminated sheath has a characteristic feature of being advantageously moisture-proof as well as having a superior mechanical strength. Thus, laminated sheaths have been used in various kinds of products such as electric wire cables, pipes for conveying heated fluids, and waveguide tubes having an elliptic cross-section. An example of such a laminated sheath, which is commonly available at present is shown in FIG. 1. In FIG. 1, reference numeral 2 denotes an insulated wire core for an electric power cable, a communication cable or the like which is hereinafter simply referred to as a "core". The core 2 has a conductor around which an insulating material is provided covering the conductor or an assembly of a plurality of such conductors provided with insulating materials. If necessary, a metal shield, binder or the like may be provided on the core 2.

Around the core 2 is provided a laminated tape 5 which is formed by a metal tape 3 (for example, aluminum tape) with adhesives 4 (for example, ethylene copolymer) on one or both sides thereof with the laminated tape 5 partially overlapping itself to form a tube shape so as to cover the core 2. The overlapping portion 6 is heated so the ends of the tape which are in contact with each other are bonded to each other. Around the tape 5 which is thus laminated is provided a sheath 7 made of plastics such as polyethylene (PE), polyvinyl chloride (PVC) or the like covering the laminated tape 5. Thus, the sheath 7 is adhered to the laminated tape 5 so as to form a laminated sheath cable 1.

As to the technique for producing such a laminated sheath cable, there have conventionally been known the following methods:

A first method is illustrated in FIG. 2. This method is most commonly used.

In FIG. 2, the core 2 is supplied in a continuous manner from a supply stand 8 while at the same time a tape 5 to be laminated is longitudinally supplied around the outer periphery of the core 2 from a supply stand 9. The core 2 and the tape 5 then pass to a machine 10 which imparts a desired shape. The machine 10 operates to provide the laminated tape 5 in the form of a tube around the core 2 to thus cover the core 2. Usually, the machine 10 is constructed of a plurality of rolls or dies 11 for imparting the desired shape. The core 2 is covered with a tube composed of the laminated tape 5 as mentioned above. After initially covering the core, the core 2 and the tape 5 are preheated by a preheater 12 thereby subjecting the laminated tape 5 at the overlapping portion 6 (FIG. 1) to an adhering treatment. Immediately thereafter, the sheath 7 is extruded from an extruder 14 and applied over the laminated tape 5 around the core 2 covering the laminated tape 5 during the vacuumizing operation of the vacuum device 13. The laminated cable 15 thus produced is cooled while passing through a water-cooling trough 16 and taken up by a take-up device (not shown).

However, as can be seen from the sheath structure shown in FIG. 3, a problem may occur at the overlapping portion 6 of the tape in a laminated sheath cable which is produced in accordance with this method. That is, a gap is formed at a step portion 17 between the sheath 7 and the overlapping portion of the laminated tape 5. In addition, a step 18 is formed at the outer side of the sheath 7. Due to this, there is a drawback in that splitting may occur at these portions if a shock force is applied to the cable.

The laminated tape 5 which is used in this method is a coiled article which is separately produced. As a method for the production thereof, for example, it has been most common to provide adhesives on an aluminum tape using an extruder or a calender roll. In order to provide a thin layer of adhesives in a uniform thickness without damaging the covering layer of adhesives yet while enhancing the bonding strength between the aluminum tape and the adhesive, large and expensive manufacturing equipment is needed. As a result, there is the drawback in that the laminated tape is expensive.

Concerning the product quality, various drawbacks with this arrangement are also present. Specifically, during storage, blocking may occur between the laminated tapes. In addition, the surface conditions of the aluminum tape or adhesives can vary thereby lowering the bonding efficiency. Furthermore, the type of the adhesives used must be strictly chosen in order to avoid the above-mentioned problems.

A second method as illustrated in FIG. 4 may be used to overcome the drawbacks which are attendant with the first method. Reference numerals employed in FIG. 4 which are the same as those employed in FIG. 2 denote the same components. In FIG. 4, the tape which is supplied from the supply stand 9 is not laminated tape but instead is metal tape, for example, aluminum tape 19, which is formed into a tube shape around the core 2 by the machine 10. After that, the surface of the tube of aluminum tape 19 is covered with a resin 21 (adhesive) for the lamination process using an extruder 22. At the same time, the plastic sheath 7 is formed by extrusion to cover the resin 21. Reference numeral 20 denotes an extruder for the sheath which is supplied to the extrusion die portion. Other than the above-mentioned components, the apparatus of the second method does not differ from that of the first method.

In accordance with this method, it is not necessary to separately produce the laminated tape. However, other problems may arise. That is, when the aluminum tape 19 is shaped with the die 11 of the machine 10, the surface of the tape can be easily damaged inasmuch as the tape is not covered with the adhesives. Small pieces, cuttings or chips of aluminum produced when the surface of the tape is damaged can increase the resistance of the forming die. Finally, the aluminum tape 19 may be torn in half. This is a defect which should not be allowed to occur in a practical production process.

Considered from a viewpoint of quality, there are not only the same defects as in the first method in that a gap is formed at the step 24 of the overlapping portion 23 of the aluminum tape 19 as seen in the sheath structure which is shown in FIG. 5 thereby causing a weakness in the structure, but also other defects, for example, the weakening of the waterproof sealing of the laminated sheath and the mechanical strength of the cable may occur. Furthermore, a damaged surface of the aluminum tape may corrode by the action of water due to the fact that the overlapping of the aluminum tape 19 may not be in close contact with each other. Due to these problems, the reliability of the cable over a long period may be significantly lowered using this method. In FIG. 5, reference numeral 7 denotes a sheath and reference numeral 21 denotes adhesives.

In order to solve the problems which arise with the use of the second method, the first and second methods can be combined. In other words, before the aluminum tape is supplied and shaped, the adhesive such as resin used for laminating or the like is provided on one side of the tape portions to be overlapped using a calender roll or the like in such a manner as to cover the one side. Then immediately, the steps of shaping the tape and extruding the sheath are carried out in the same way as indicated in FIG. 2.

This combination of the first and second methods is disadvantageous in that the method is complex to implement, especially for the step of covering the surface of the aluminum tape with the adhesive, in the same manner as already stated in connection with the first method. Thus, it can be easily understood that the overall manufacturing efficiency is low as a whole if the above-mentioned covering step is carried out in conjunction with the step for extruding the sheath. In addition, the quality problem which is due to the step at the overlapping portions of the laminated tape as mentioned above has yet to be solved.

Nonetheless, the second method is very advantageous in comparison with the first method in that long cables can be produced in a continuous manner inasmuch as a metal tape welder, such as a cold welder which is conventionally available, may be employed without modificaion in connecting the tape. Thus, the second method is most suitable in applications requiring continuity at the connecting portion of an external conductor such as a laminated sheath coaxial cable for use with CATV. In addition, in view of the fact that the laminated tape can be produced simultaneously with the sheath covering making use of a unit member of aluminum tape, it goes without saying that the second method is advantageous in terms of production cost in comparison with the first method from a viewpoint of energy requirements.

SUMMARY OF THE INVENTION

It is thus the primary object of the present invention to overcome the problems mentioned above. In accordance with the present invention, the second method in which a unit member of metal type is used is improved so that the surface of the tape is not damaged when the tape is shaped. Moreover, in accordance with the invention, the step at the overlapping portion of the tape is filled with adhesive so as to remove the gap at the overlapping portion. The tape and the sheath are firmly bonded to each other with the adhesive. Preferably, the overlapping portions of the tape are completely bonded to each other thereby enhancing the air-tightness as well as the mechanical strength so that a laminated sheath article such as laminated sheath cable may easily be produced using only a single process.

The present invention specifically provides a method for producing a laminated sheath article, for example, a laminated sheath cable, including the steps of longitudinally supplying a tape of metal or the like, at least partially forming the tape into a tubular shape in a preliminary step, and passing the tape through at least one die to which is supplied adhesive. The adhesive flows onto the tape because the tape has the tubular shape thereby covering the tape with the adhesive and filling at least the step portion of the laminated part of the tape with the adhesive. Immediately thereafter, the tape is covered with a protective sheath made of plastics or the like by an extrusion device.

For example, in the case of a cable, the tape which is used in the present invention may be made of aluminum, copper, or an alloy thereof, stainless steel, lead or the like. In case of need, a laminated or a complex tape can be also used.

DESCRIPTION OF THE PREFERRED EMBODIMENTS

Figure 6:
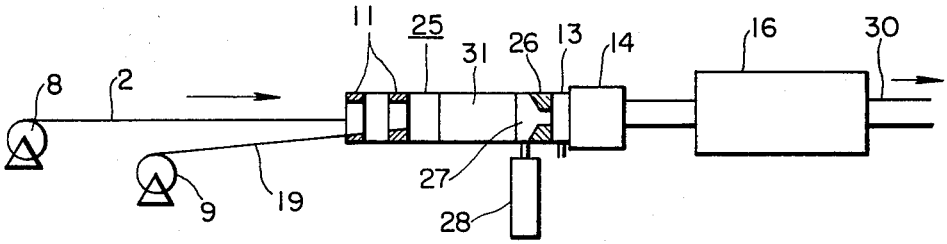
FIG. 6 is a cross-sectional view showing a cable produced in accordance with the present invention.

FIG. 6 is a schematic diagram of a laminated sheath producing apparatus operating in accordance with a preferred embodiment of a method of the present invention. The apparatus of FIG. 6 may be used to produce laminated sheath cable as an example. The reference numerals in FIG. 6 which are the same as those used in FIG. 2 and FIG. 4 denote like components.

Figure 4:
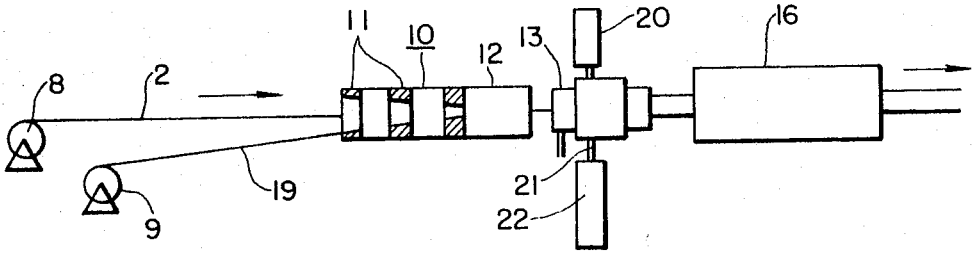
Figure 5:
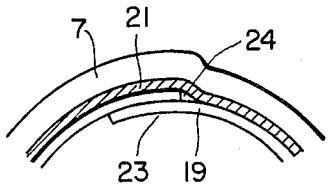
FIG. 5 is a transverse cross-sectional view showing the laminated sheath portion of the cable which is obtained in accordance with the method shown in FIG. 4.

In FIG. 6, the core 2 for the cable and the metal tape, for example, the aluminum tape 19, are longitudinally supplied to a machine 25 which forms them to the desired shape in the same manner as depicted in FIG. 4 as in the conventionally employed second method. However, the method illustrated in FIG. 6 differs from the second method in the following points.

When the aluminum tape 19 is formed into the shape of a tube, the tape is passed not only through the conventionally employed die 11 but also through at least an additional die 26 for imparting the tubular shape as well as for precoating the tape with the adhesive. (The second die 26 is hereinafter simply referred to as a "squeezing die".)

FIG. 6 shows an example wherein the die 26 is arranged just in front of the cross-head of a sheath extruder 14. The adhesive 27 is retained in the squeezing die 26 in such a manner as to be able to flow. The adhesive 27 is supplied from supplying device 28. The aluminum tape 19, after being bent into a tubular shape as a preparatory step by the die 11, is passed through the squeezing die 26 thereby covering the outer surface of the tube of the aluminum tape 19 with the adhesive 27. In addition, the step portion 32 of the overlapping parts of the aluminum tape 19 as well as the portion 29 (FIG. 7) at which the edge portions of the tape are in contact with each other are also filled with the adhesive. Thus, the tube is shaped completely as desired.

Further in FIG. 6, reference numeral 31 denotes a preheater which preheats the aluminum tape 19 after the preparatory shaping step. Immediately after these steps, a sheath 7 of plastics is extruded from the cross-head of the sheath extruder 14. The tube is covered with the sheath 7 of plastics and cooled in the cooling trough 16 if necessary. Thus, a laminated sheath cable 30 in accordance with the present invention is produced.

Figure 7:
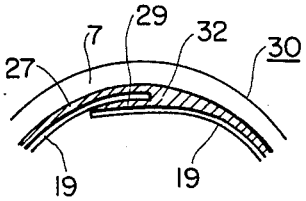
FIG. 7 is a transverse cross-sectional view showing the laminated sheath portion of the cable shown in FIG. 6.

A laminated sheath cable which is produced in accordance with this method has a sheath structure as shown in FIG. 7. In FIG. 7, the step portion 32 of the overlapping part of the aluminum tape 19 as well as the overlapping portion 29 itself where the edge portions of the tape are in contact with each other are filled with the adhesive 27 so as to maintain a suitable stable sealed state. In particular, it can be seen that the portion in the vicinity of the overlapping portion is filled with the adhesive 27 to such an extent that there is no gap. On the other hand, the outer surface of the aluminum tape 19 and the sheath 7 are completely bonded to each other by the adhesives 27. As a result, the metal tape 19, the adhesive 27 and the sheath 7 are made completely integral with one another. In addition, since there is substantially no effect due to the presence of the overlapping portion, the sheath 7 presents a uniform appearance. As the consequence, the laminated sheath of the invention has superior airtight and waterproof qualities as well as improved mechanical strength. Thus, the cable in accordance with the present invention has much improved characteristic features in comparison with the conventional cable constructed in accordance with the first method illustrated in FIG. 2. In particular, in the case of a cable in which the moisture-proof property is important, since the adhesive is supplied to the overlapping portion 29, the mechanical strength at the overlapping portion of the tape as well as the moisture-proof property are simultaneously enhanced.

Furthermore, there is no need for continuity between the edges of the tape at the overlapping portion 29.

Next, various significant features of the present invention will be explained in more detail.

(1) In case the tape is to be formed into a tubular shape, it is desirable that the tape be initially shaped by a first die or roll only in a preparatory manner and that the tape be imparted the final shape by the squeezing die into which the adhesive is supplied. One reason for this is that, if a metal tape without any coating thereon is given the final shape, the surface of the metal tape can be easily damaged as explained above with reference to FIG. 4. As a result, small pieces, cuttings or chips of metal are produced, thereby making it difficult to form the desired tubular shape. On the contrary, if the tape is imparted the tubular shape while covering the tape with the adhesive in the squeezing die, the adhesive functions as a lubricant. As a consequence, the above-mentioned difficulty does not occur. Thus, the tape is easily shaped as desired. In addition, it becomes possible to provide the adhesive on the tape in a quite thin layer due to the repulsive force of the tubularly-shaped tape against the squeezing die. It goes without saying that the strength of the repulsive force of the tape may vary depending upon the radius of curvature of the tape. Therefore, it is possible to vary the repulsive force or the thickness of the layer of the adhesive applied to the tape by varying the radius of curvature of the tape. Another important reason why it is desirable to use the initial shaping step is that if the tape is passed through the squeezing die after having been completely imparted the tubular shape, the supply of the adhesive to the overlapping portion of the tape becomes insufficient and hence the overlapping edges of the tape will be insufficiently bonded to each other.

In order to fully cause the overlapping edge portions to adhere firmly to each other, in particular, in case the tape is formed of a soft material and/or the tape is thin, the tape can be initially fully given the tubular shape after which the overlapping portions of the tape are opened again (preferably the edge of the tape on the outer side is opened) and then the tape is passed through the squeezing die. By so doing, it becomes possible to fill the adhesive in the overlapping portion of the tape while the overlapping portion is still imparted the desired shape. There are occasions where it is unnecessary to cause the overlapping edges of the tape to adhere to each other. In such a case, it is not necessary to open again the overlapping portion after the tape is tubularly shaped in the initial step.

(2) It is preferable that the tools such as the die or roll for shaping the tape in the preparatory step have die surfaces formed of fluoride resin or any other resin such as nylon which is at least softer than the tape. This is because harder die surfaces may damage the metal tape, and if the metal tape is damaged, water can enter the damaged portion in use thereby lowering the adhesion force due to corrosion of the tape or the like or lowering the mechanical strength.

In case a particularly high adhesion force is required, the surface of the metal tape can be made rough, and the adhesive supplied onto the roughened surface in such a manner as to be adhered thereto due to the pressure of the squeezing die. The roughened surface will be more completely covered with the adhesive. Problems such as corrosion or the like due to the penetration of water do not then occur.

(3) One squeezing die 26 is shown in FIG. 6. However, two or more squeezing dies or the like are preferably used if desired in accordance with the present invention. In case two squeezing dies are used, for example, the adhesive is filled in the overlapping portion of the tape using the first squeezing die. In the second squeezing die the adhesive is applied on the overlapping portion of the tape as well as other parts in such a manner as to cover the entire tubularly-shaped tape. In general, the pre-filling of the adhesive in the overlapping portion of the tape is an important technique in the invention.

(4) It is important in obtaining an excellent adhering force to employ a tape which is free from contaminations. It goes without saying that the tape should be cleaned prior to use if necessary. In the invention, however, as the tape is passed through the squeezing die and the adhesive is coated onto the tape using the shear stress in the adhesive, contaminants such as dust, oil or the like on the surface of the tape can be moved. When the tape is initially formed in the tubular shape, it may be advantageous, for example, to provide a lubricant in order to prevent the tape from being damaged. The lubricant can be easily removed by the adhesive in the squeezing die when an excess amount of the adhesive is supplied to the squeezing die and some of the adhesive is dripped from the die.

(5) It is important to clean the tape before the tape is covered with the adhesive, in particular, if the tape is used as an external conductor such as for a coaxial cable. If a layer having a poor conductivity is present on the surface of the metal tape, the transmission loss through the cable for high frequencies increases significantly. Therefore, it is desired that the surface of the metal tape be cleaned by electrolytic washing or the like, preferably just before the adhesive is coated onto the tape. By so doing, a strong adhesion force between the adhesive or between the sheath material and the tape is obtained.

(6) It is quite important to preheat the adhesive and the tape prior to coating. In general, the higher the heating temperature, the stronger the adhesion force will be. However, if the temperature is too high, the adhesion force is weakened due to chemical deterioration of the adhesive. Moreover, an excessively high temperature may thermally distort the core material. Thus, there is an upper limit to the heating temperature. In case the core material is a polyethylene of a low density, the upper temperature limit for preheating is about 100° C. The lower temperature limit is generally the softening temperature of the material. Proper control of the preheating temperature is very important to the process of the invention. A temperature control device is preferably provided which maintains the best temperature during all times when the process is being carried out and even, for examle, when operations are temporarily stopped. A control device which controls both the process operating speed and the preheating temperature is extremely effective.

(7) Although it is not at all impossible to cover the tape with the adhesive after the tape has been initially shaped by extruding and coating the adhesive onto the aluminum core using a known pressure type cross-head and employing a high pressure, it is necessary to cover the tape with the adhesive under as low a pressure as possible so as to avoid distortion of the tape and the core. To this end, it is preferable to supply the adhesive in the squeezing die by an adhesive extruder or the like and to coat the adhesive onto the tape making use of the shearing stress which is developed in the adhesive due to movement of the tape while using a low pressure. This method is advantageous, in comparison with a method where the adhesive and the sheath material are respectively supplied by two separate extruders so as to cover the tape in that there is no danger that the speeds of operation of two extruders will become unbalanced. The use of two extruders would require periodic adjustments. On the other hand, with the invention it is possible to cover the tape with the adhesive at a uniform thickness at all times.

(8) The squeezing die 26 may be located at some distance from the sheath extruder 14. But, in view of efficiency, it is most desirable that the squeezing die 26 be set at the entrance of the cross-head of the sheath extruder 14. The reason for this is that the cross-head of the sheath extruder is usually a draw-down type and sufficient vacuumizing must be done in order for the sheath material to be perfectly in contact with the core. If the die 26 is provided at the entrance of the cross-head, a seal in the cross-head may be provided, thereby enhancing the vacuumizing efficiency and firmly bonding the adhesive and the sheath.

Immediately after the tape is covered with the adhesive, the sheath should be attached. Surfaces of the sheath and the adhesive which are formed of active substances at a high temperature are contacted with each other thereby making it possible to ensure complete adhesion.

The thermally decomposed gas or water component which is generated from the surface of the adhesive and the sheath is removed due to the vacuum pressure thereby resulting in firm contact between the adhesive and the sheath.

However, if a draw-down sheath is not required, for example, in case a sheath such as a solid sheath is extruded under a high pressure, it is possible that the portion within the cross-head, in particular, the nipple end within the cross-head of the sheath extruder 14, be also used as the squeezing die. In this case, vacuumizing, which is a troublesome operation, may be omitted. Even when a draw-down sheath is used, the nipple end may also easily be used as a squeezing die, for example, if a hole for vacuumizing is formed in the nipple end. In case the nipple end is used as the squeezing die, it is possible to add the sheath covering while the core to be sheathed is held at the center of the nipple end. This is quite effective in obtaining a uniform thickness of the sheath.

(9) The inlet diameter of the squeezing die is larger than the outlet diameter thereof. As the tape is moved, a shear stress is developed in the adhesive provided in the squeezing die. The air contained in the adhesive is removed. The adhesive is provided on the surface of the tape in a layer as thin as possible. These are the most important points in ensuring complete adhesion. Therefore, it is possible to vary the state of covering the tape with the adhesive by varying the configuration of the squeezing die so that the shear stress produced before adhesion is varied. For example, it becomes possible to coat on the adhesive in such a manner as to form an extremely thin layer thereof if the tapering angle at the entrance of the squeezing die is set to be larger than 90°. In addition, since the quantity and viscosity of the adhesive in the squeezing die also affect the shear stress, it is also possible to control thickness of the coated adhesive by varying the quantity or viscosity of the adhesive.

If a plurality of squeezing dies of a different or the same type are provided to preliminarily shape the tape, an adhesion effect which is more advantageous than for only a single squeezing die can be provided.

(10) An adhesive of any kind may be used provided that the adhesive has a viscosity enabling the adhesive to flow to the overlapping portion of the tape.

It is preferable to use a hot-melt type adhesive as an adhesive which can be thermally fused and bonded. An adhesive of a copolymer type of a polyolefin system, for example, a binary or ternary copolymer such as ethylene and vinyl acetate, acrylic acid or ester, meta-acrylic acid or ester, glycidyl metacrylic acid or ester, or the like which is heated and rendered thermally flowable can be used. The adhesive must be coated onto the tape in such a manner as to not cause any unfavorable effect such as thermal distortion. In general, it is desired that the adhesive be bonded on the tape at a temperature which is lower than the softening point of the core material. In other words, in case an adhesive capable of being thermally fused and bonded is used, it is required that the softening point of the adhesive be lower than that of the core material.

In a special case, it is advantageously possible to use the adhesive having a higher softening point than those of the core materials to tightly adhere the core to the laminated sheath.

(11) Inasmuch as the usual sheath production line is laterally arranged, it is desirable that the adhesive have a viscosity sufficiently high that the adhesive cannot be dripped by force of gravity from the squeezing die 26. Since the adhesive is not required to be dried, an adhesive of a thermally fusing and bonding type is most suitable.

Since the thickness of the adhesive layer on the surface of the metal tape should have a uniform thickness, the higher the viscosity of the adhesive, the more uniform will be the thickness of the adhesive since the squeezing die portion compensates for any unevenness in the thickness. On the other hand, in order to make the adhesive to flow into the overlapping portion of the tape and to provide as thin a layer of the adhesive as possible, it is advantageous that the viscosity be low. Taking into account these two opposing considerations, the viscosity value may be determined.

Figure 1:
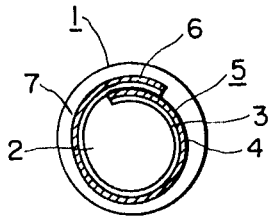
FIG. 1 is a transverse cross-sectional view showing an example of the structure of a laminated sheath cable.
Figure 3:
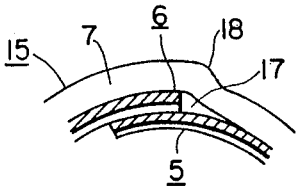
FIG. 3 is a transverse cross-sectional view showing a laminated sheath portion of a cable produced in accordance with the method illustrated in FIG. 2.
Figure 2:
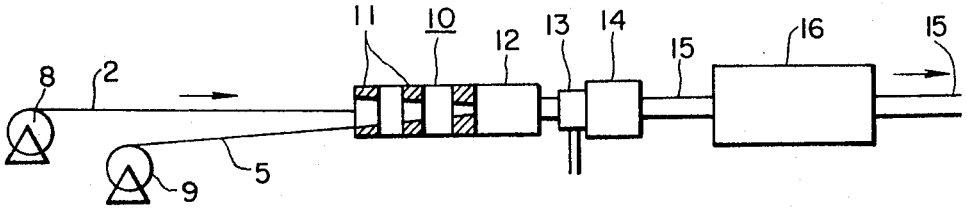
FIG. 2 and FIG. 4 are cross-sectional views for an explanation of conventional first and second methods respectively.

(12) The sheath can be extruded using a commonly known extrusion method. However, it is desirable to employ a noneccentric extrusion method. As opposed to the conventional method as illustrated in FIG. 2, two steps (a step to produce the laminated tape and a step to extrude the sheath) are provided in a tandem manner in the present invention. Thus it is desired to simplify the overall processing operations, in particular, at the starting time of the operations or at the time when the operations are temporarily stopped. Taking this into account, the present invention provides the best method for covering the tape with the adhesive by a combination of the squeezing die system and the sheath extrusion system.

A specific example of an application of the invention will now be discussed.

In accordance with the method as illustrated in FIG. 6, a laminated sheat coaxial cable was produced. As the core, foam polyethylene insulation having an outer diameter of 7.5 mm was used. As the metal tape, aluminum tape having a thickness of 0.15 mm and a width of 29 mm was used. First, the tape was shaped to have an outer diameter of 8.5 mm in a preparatory step by the die 11 of the machine 25. After this step, the aluminum tape was preheated to a temperature of 100° C. by the preheater 31 and then passed through the squeezing die 26 of which the hole size was 7.8 mm. An ionomer (Mitsui Oil Co.'s Hymyrane 1652) was used as the adhesive. The temperature of the squeezing die and the adhesive was approximately 200° C. On the tape thus covered with the adhesive was applied low density polyethylene at a temperature of 200° C. by a 65 mm sheath extruder in a drawdown manner to form the sheath thereon. In this case, the vacuum pressure used was 20 mm Hg.

The cross-sectional structure of the laminated sheath coaxial cable thus produced in accordance with the present invention is shown in FIG. 7. The step portion of the overlapping part of the metal tape and even the contacting edge portions of the tape were in contact with each other and the area was fully filled with the adhesive. The overall appearance was excellent.

The adhesion strength was measured in accordance with a 180° peeling test. As a result, it was determined that the adhesion strength between the aluminum tape and the polyethylene sheath was 4.2 Kg/cm (width direction) and the adhesion strength in the area where the edge portions of the aluminum tape were in contact with each other was 3.8 Kg/cm (width direction). As far as the adhesion strength is concerned, this cable was superior to a cable produced in accordance with the conventional first method as illustrated in FIG. 2. In particular, the adhesion strength between the overlapping portions of the tape for the cable of the invention was three times as strong as that of a cable of the conventional first method. The adhesion strength of the conventional second method was almost 0 Kg/cm. In the low temperature impact test at 30° C., 1 foot-lbs, percentage of the damaged sample of this invention was 0%. The sample of the first method was 15%, the second method was 85%.

In accordance with the method of the present invention as mentioned above, the tape is passed through at least one die (squeezing die) where the adhesive is supplied and at the same time the tape is shaped. The adhesive is flowable when the tape is imparted the tubular shape by the shaping machine. The tape is coated with the adhesive and the adhesive is filled at least in the step portion of the overlapping parts of the tape. Immediately after that operation, the tape is covered with the sheath.

Due to the shear stress caused by the movement of the tape, which has been previously formed into a tubular shape, the adhesive is filled not only on the surface of the tape but also at the step portion of the overlapping parts of the tape and in the vicinity of areas where the ends of the tape are in contact with each other. In addition, since the filling quality of the adhesive and the thickness of the coating are not affected by the extrusion of the sheath, there is no air gap at the overlapping portions of the tape, and the tape and the sheath are in contact with each other perfectly. As a result, the present invention provides a laminated sheath product having the desirable properties of being air-tight and waterproof as well as excellent mechanical strength and an adhesion force which is stronger than that of a product which is obtained in accordance with conventional methods using laminated tape.

If a lubricant is used in order to prevent the tape from being damaged when the tape is initially shaped, it is possible that the lubricant can be removed by the adhesive in the squeezing die in accordance with the present invention. Even if a lubricant is not used, the tape can be shaped as desired at the squeezing die portion without damaging the surface of the tape due to the lubricating effect of the adhesive. As a result, the tape will not corrode and the adhesion force will not be weakened due to damage to the surface of the tape or the presence of the small pieces, cuttings or chips.

In accordance with the method of the invention, it is not necessary to produce laminated tape with a separate procedure. The production of the laminated tape (the covering of the tape with the adhesives) and the extrusion of the sheath is effected in accordance with the invention during a single process. In addition, since it is not necessary to adjust the covering condition of the adhesive with the squeezing die, there is an advantage in that the production is quite easy and low production cost is ensured.

In the description hereinabove, a method for producing laminated sheath cable has been given as an example in order that the present invention may be easily understood. However, the present invention is not limited thereto and is applicable to other articles such as a tube composed of a laminated sheath and applications without a core material, for example, a pipe for conveying a heated medium such as hot water or a wave guide tube having an elliptical cross-section. Although it has been explained hereinabove that the present invention is most advantageous when a single layer of the metal tape is used, it goes without saying that other tapes such as laminated or complex tapes may also be used. Although in the example above, plastics is extruded by an extruder and provided on the tape, it goes without saying that the present invention is not limited thereto.

What is claimed is:

1. A method for producing a laminated sheath comprising the steps of: longitudinally supplying a tape; passing said tape through forming means for forming said tape into at least a partial tubular shape; passing said tape through a die for forming said tape into a desired tubular shape; supplying an adhesive onto an outer surface of said tape prior to said tape passing through said die, said die filling at least a step portion formed between overlapping edges of said tape with said adhesive; and thereafter covering said tape with a sheath.

2. The method of claim 1 wherein said desired tubular shape formed by said die comprises a closed tubular shape having overlapping edge portions.

3. The method of claim 1 wherein said tape is formed into a complete tubular shape by said forming means and further comprising the step of partially opening at least one edge portion of said tape prior to passing said tape through said die.

4. The method of claim 1 further comprising the step of supplying a lubricant onto surfaces of said tape in contact with surfaces of said forming means.

5. The method of claim 1 wherein surfaces of said forming means are made of a material softer than a material of said tape.

6. The method of claim 1 wherein said tape comprises a metal tape and further comprising the step of roughening at least an outer surface of said metal tape prior to passing said metal tape through said die.

7. The method of claim 1 wherein said die comprises a first squeezing die for filling overlapping portions of said tape with said adhesive and a second squeezing die for coating said tape with adhesive on portions other than said overlapping portions.

8. The method of claim 1 further comprising the step of cleaning said tape prior to passing said tape through said die.

9. The method of claim 8 wherein said step of cleaning said tape comprises electrolytic washing.

10. The method of claim 1 further comprising the step of preheating said adhesive and said tape prior to said tape passing through said die.

11. The method of claim 10 wherein a heating temperature of said tape and/or said adhesive is higher than a softening temperature of said adhesive and lower than a chemical decomposition temperature of said adhesive.

12. The method of claim 1 further comprising the step of providing at least a partial vacuum pressure around said die.

13. The method of claim 1 wherein said step of covering said tape with said sheath comprises the step of extruding a sheath onto said tape at a position closely adjacent said die.

14. The method of claim 1 wherein said die has a tapering angle at the entrance thereof of larger than 90°.

15. The method of claim 1 wherein said adhesive comprises a copolymer type of a polyolefin system.

16. The method of claim 15 wherein said adhesive comprises a material selected from the group consisting of a binary or trinary copolymer including ethylene and acetic acid, acrylic acid, meta-acrylic acid, glycidyl metacrylic acid, or an ester thereof.

17. The method of claim 1 wherein said adhesive has a viscosity sufficiently high that said adhesive cannot be dripped through said die by the force of gravity.

18. A laminated sheath prepared by a method comprising the steps of: longitudinally supplying a tape; passing said tape through forming means for forming said tape into at least a partial tubular shape; passing said tape through a die for forming said tape into a desired tubular shape; supplying an adhesive onto an outer surface of said tape prior to said tape passing through said die, said die filling at least a step portion formed between overlapping edges of said tape with said adhesive; and thereafter covering said tape with a sheath.

19. The laminated sheath claimed in claim 18 wherein said desired tubular shape formed by said die comprises a closed tubular shape having overlapping edge portions.

20. The laminated sheath claimed in claim 18 wherein said tape is formed into a complete tubular shape by said forming means and further comprising the step of partially opening at least one edge portion of said tape prior to passing said tape through said die.

21. The method of claim 18 further comprising the step of supplying a lubricant onto surfaces of said tape in contact with surfaces of said forming means.

22. The method of claim 18 wherein surfaces of said forming means are made of a material softer than a material of said tape.

23. The method of claim 18 wherein said tape comprises a metal tape and further comprising the step of roughening at least an outer surface of said metal tape prior to passing said metal tape through said die.

24. The method of claim 18 wherein said die comprises a first squeezing die for filling overlapping portions of said tape with said adhesive and a second squeezing die for coating said tape with adhesive on portions other than said overlapping portions.

25. The method of claim 18 further comprising the step of cleaning said tape prior to passing said tape through said die.

26. The method of claim 25 wherein said step of cleaning said tape comprises electrolytic washing.

27. The method of claim 18 further comprising the step of preheating said adhesive and said tape prior to said tape passing through said die.

28. The method of claim 27 wherein a heating temperature of said tape and/or said adhesive is higher than a softening temperature of said adhesive and lower than a chemical decomposition temperature of said adhesive.

29. The method of claim 18 further comprising the step of providing at least a partial vacuum pressure around said die.

30. The method of claim 18 wherein said step of covering said tape with said sheath comprises the step of extruding a sheath onto said tape at a position closely adjacent said die.

31. The method of claim 18 wherein said die has a tapering angle at the entrence thereof of larger than 90°.

32. The method of claim 18 wherein said adhesive comprises a copolymer type of a polyolefin system.

33. The method of claim 32 wherein said adhesive comprises a material selected from the group consisting of a binary or trinary copolymer including ethylene and acetic acid, acrylic acid, meta-acrylic acid, glycidyl metacrylic acid or an ester thereof.

34. The method of claim 18 wherein said adhesive has a viscosity sufficiently high that said adhesive cannot be dripped through said die by the force of gravity.

* * * * *